US005645232A

United States Patent [19]

Staples et al.

[11] Patent Number: 5,645,232

[45] Date of Patent: Jul. 8, 1997

[54] TANK CLEANING APPARATUS AND METHOD

[76] Inventors: Wesley A. Staples, Rte. 3, Box 1512; Russell E. Staples, Rte. 5, Box 8082, both of Palatka, Fla. 32177

[21] Appl. No.: 654,935

[22] Filed: May 29, 1996

Related U.S. Application Data

[63] Continuation of Ser. No. 331,946, Oct. 31, 1994, abandoned.

[51] Int. Cl.[6] ..... B02C 19/00

[52] U.S. Cl. ..... 241/60; 134/168 R; 299/1.5; 299/39.4; 241/101.72; 241/101.742; 241/165.5

[58] Field of Search ..... 134/168 R, 181; 180/6.2; 239/227, 722; 299/1.5, 25, 30, 40.1, 39.4–39.8; 241/38, 60, 101.72, 101.74, 101.742, 101.77, 101.762, 101.763, 152.2, 165.5, 152.1, 277, 282.1, 282.2

[56] References Cited

U.S. PATENT DOCUMENTS

| | | | |
|---|---|---|---|
| 3,496,977 | 2/1970 | Gifford | 241/101.763 X |
| 3,779,408 | 12/1973 | Ivie | 241/101.72 X |
| 4,412,660 | 11/1983 | Morin | 241/101.742 |
| 4,619,412 | 10/1986 | Willingham | 241/101.762 |
| 4,683,924 | 8/1987 | Cornelius | 241/101.72 X |
| 4,744,396 | 5/1988 | Smith | 241/101.74 X |
| 5,185,899 | 2/1993 | Urbani | 15/93.1 |
| 5,240,188 | 8/1993 | Whitmire | 241/101.763 X |
| 5,279,012 | 1/1994 | Sloan | 15/1.7 |

*Primary Examiner*—Mark Rosenbaum
*Attorney, Agent, or Firm*—Kerkam, Stowell, Kondracki & Clarke, P.C.; John C. Kerins

[57] ABSTRACT

A knockdown tank-cleaning apparatus that is easily broken down and reassembled is provided. The tank-cleaning apparatus, when knocked down, easily fits through a standard man-way opening in the side of the tank. The tank-cleaning apparatus includes a knockdown frame having wheels releasably attached thereto. A header assembly is releasably attached to the front of the knockdown frame. The header assembly includes a cutter head releasably and rotatably disposed in the header assembly. The header may optionally include a throat portion, in which a cross-chopper assembly is disposed. Bottom-deposited materials are broken up by rotation of the cutter head. The loosened material is fed to the cross-chopper assembly where it is further reduced and formed into a slurry. The slurry is pumped from the tank to the exterior of the tank where reclamation of valuable materials from the slurry is performed.

31 Claims, 8 Drawing Sheets

FIG. 5
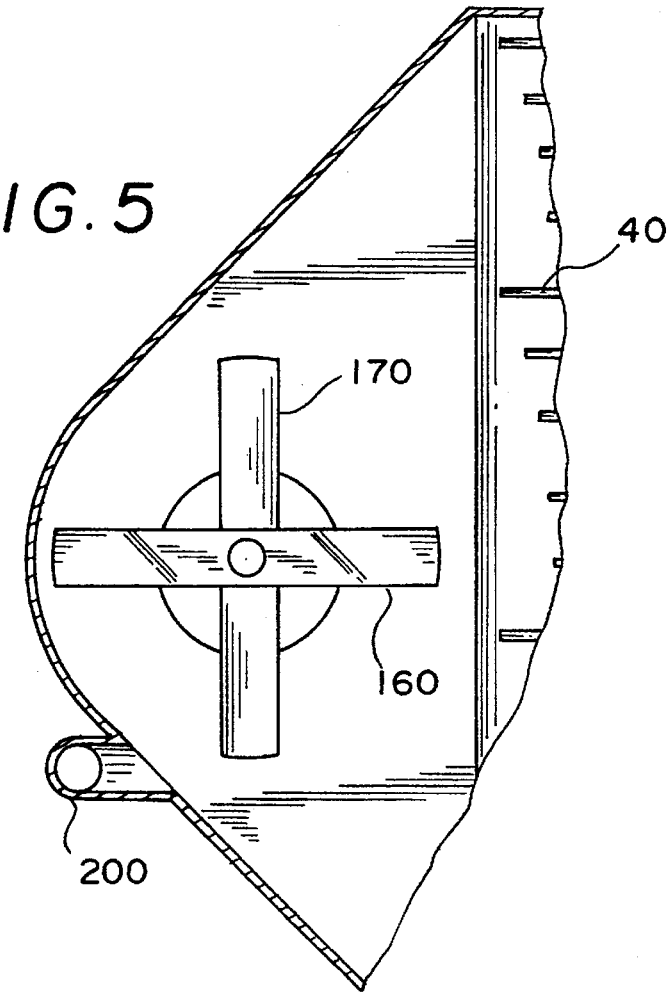
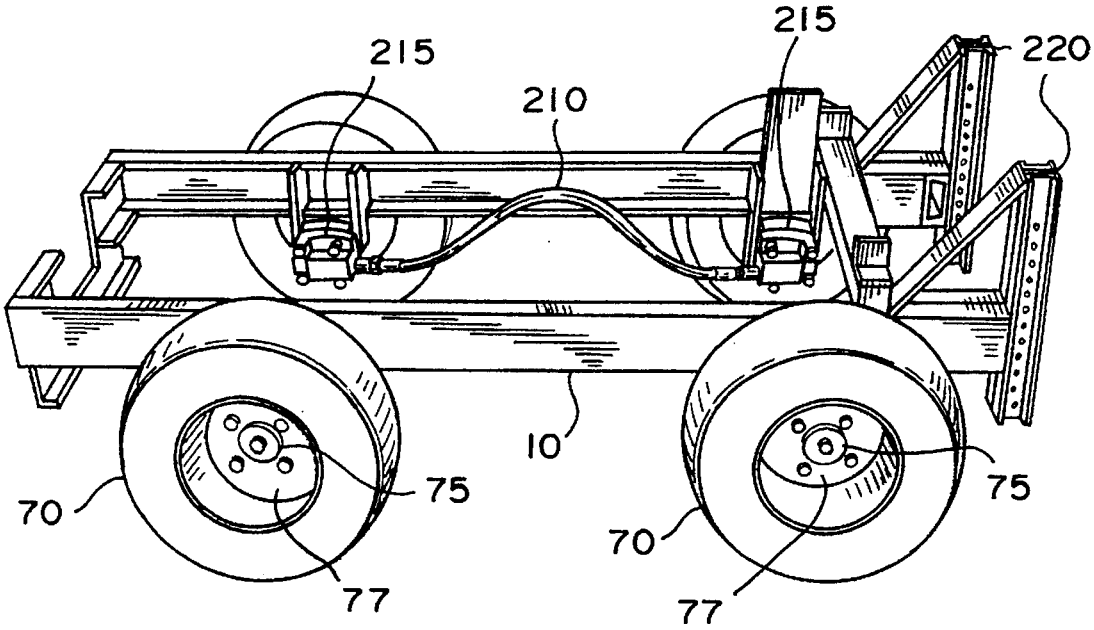
FIG. 6

TANK CLEANING APPARATUS AND METHOD

This application is a continuation of application Ser. No. 08/331,946, filed Oct. 31, 1994, now abandoned.

FIELD OF THE INVENTION

The present invention relates to an apparatus for cleaning built-up solids in a holding tank, and, in particular, to an apparatus that is designed to break down to fit through a standard man-way opening in the tank and which is reassembled therein.

BACKGROUND OF THE INVENTION

In the fields of high technology, heavy industrial and chemical processing, there exist a multitude of material handling problems. At times, some of these problems become so severe that they can shut down manufacturing components or entire units while the material handling units are cleaned. One such problem involves tank cleaning in a wide range of industries, such as, for example, pulp and paper industries, chemical industries, mining and refinery industries and steel industries. These problems exist when a liquid in a holding tank can no longer dissolve further solids, and the solids fall out or are precipitated and load the bottom of a holding or treating tank. Such fallout, in time, reduces tank capacity, stopping pumps, and, in some cases, locking in valuable capital cost of material.

A standard method of removing the built-up solids from the bottom of the tank has been to take the tank "off-line," i.e., no more liquid or solids are introduced into the tank, and the tank is disconnected from the plant which supplies it. When the tank is off-line, as much liquid as possible is removed from the tank. A hole is then cut into the side of the tank and a front-end loader, such as, for example, a Bobcat, or the like, is used to scoop out the built-up solids. The solids thus removed are loaded onto trucks or other suitable transport means and taken to landfills for disposal.

The standard removal method has many associated disadvantages. For example, the material removed from the tank is generally deposited in a landfill. Environmental concerns make landfilling the recovered solids increasingly undesirable. Additionally, by disposing of the built-up solids, there is no recovery of valuable material contained in the solids. Moreover, in the conventional method described above, the tank must be cut open to recover the built-up solid material. Therefore, the tank must be either repaired or replaced. Conventional tank-cleaning methods also involve disadvantages relating to cost and time. Another disadvantage associated with conventional tank-cleaning techniques is that operating any type of combustion engine in a closed tank environment poses significant safety risks.

Therefore, what is needed is a system for removing built-up solids from a tank bottom that does not require destruction of the tank, alleviates some of the environmental impact of depositing the removed solids in landfills and allows the safe reclamation of valuable products contained in the tank.

SUMMARY OF THE INVENTION

It is, therefore, an object of the invention to provide a system for removing built-up solids from a tank bottom without damaging the tank.

It is another object of the invention to reclaim the value of the built-up solids.

It is yet another object to provide a more environmentally sound solids recovery system.

Another object of the claimed invention is to provide a safe and effective way to remove built-up solids from the tank bottom.

In order to achieve these and other objects and to overcome the disadvantages set forth above with respect to current tank-cleaning technology, a knockdown tank-cleaning apparatus is provided that includes a knockdown frame having a plurality of wheels disposed about its periphery that are releasably attached thereto; and a header detachably coupled to a front portion of the knockdown frame, the header including a cutter head detachably and rotatably disposed within the header.

The tank-cleaning apparatus may optionally include a throat for receiving material from the cutter head when the cutter head is rotatably actuated by a driving mechanism, a cross-chopper disposed within the throat for further reducing the materials received from the cutter head, and an opening through which the reduced material is transported to a pump; and a pump releasably coupled to a rear portion of the frame for pumping the reduced material to either the outside of the tank or to a predetermined location within the tank for subsequent pumping to a location outside the tank.

In another embodiment, the need for having a separate cross-chopper assembly and pump may be alleviated by providing a pump having cross-chopping impellers provided integrally with the pump. In this embodiment, material that is loosened by the header is fed directly to the pump which, in turn, further reduces the loosened material and pumps the reduced material either outside the tank or to a predetermined location for subsequent pumping to a location outside the tank.

Another alternative embodiment uses the header alone to process the bottom-deposited solids. In this embodiment, the tank-cleaning apparatus does not have any apparatus for processing the material following loosening by the header assembly. The header assembly comprises the rotating cutter head only. Material loosened by the cutter head is pumped out of the tank by a separate pump. The header of this embodiment may optionally include one or more pipe fittings for adapting a hose, or the like, thereto for introducing water to the material loosened by the cutter head to form a slurry that is more easily pumped out of the tank.

The invention also provides a method for cleaning a tank including the steps of: breaking down a knockdown tank-cleaning apparatus; draining excess fluids from the tank; depositing the broken down apparatus into the tank via a pre-existing man-way; reassembling the apparatus inside the tank; and removing the solids.

When removing the solids according to the invention, a slurry of built-up solids and liquid can be formed. This slurry can then be reintroduced to the processing plant for recovery of a substantial reusable portion of the built-up solids.

Additionally, all moving parts of the apparatus, including the cutter head, cross-chopper, an arm for raising and lowering the header assembly, the propulsion system and the pump are hydraulically actuated and controlled, thereby eliminating the need for internal combustion engines, and the like, inside the tank.

BRIEF DESCRIPTION OF THE DRAWINGS

The invention will be described herein in conjunction with the following drawings, in which like reference numerals refer to like elements, and wherein:

FIG. 5 is a diagram showing the cross-chopper assembly along section I—I of FIG. 3;

FIG. 6 is an illustrative diagram showing a perspective view of the frame and wheel assembly;

DETAILED DESCRIPTION OF PREFERRED EMBODIMENTS

Figure 1:
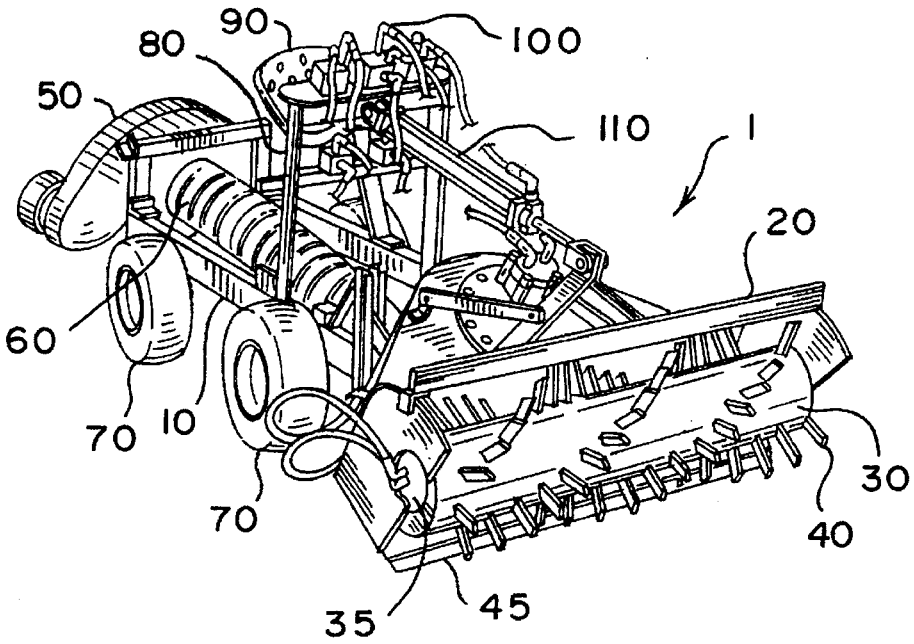
FIG. 1 is an illustrative diagram showing a front perspective view of the tank-cleaning apparatus.
Figure 2:
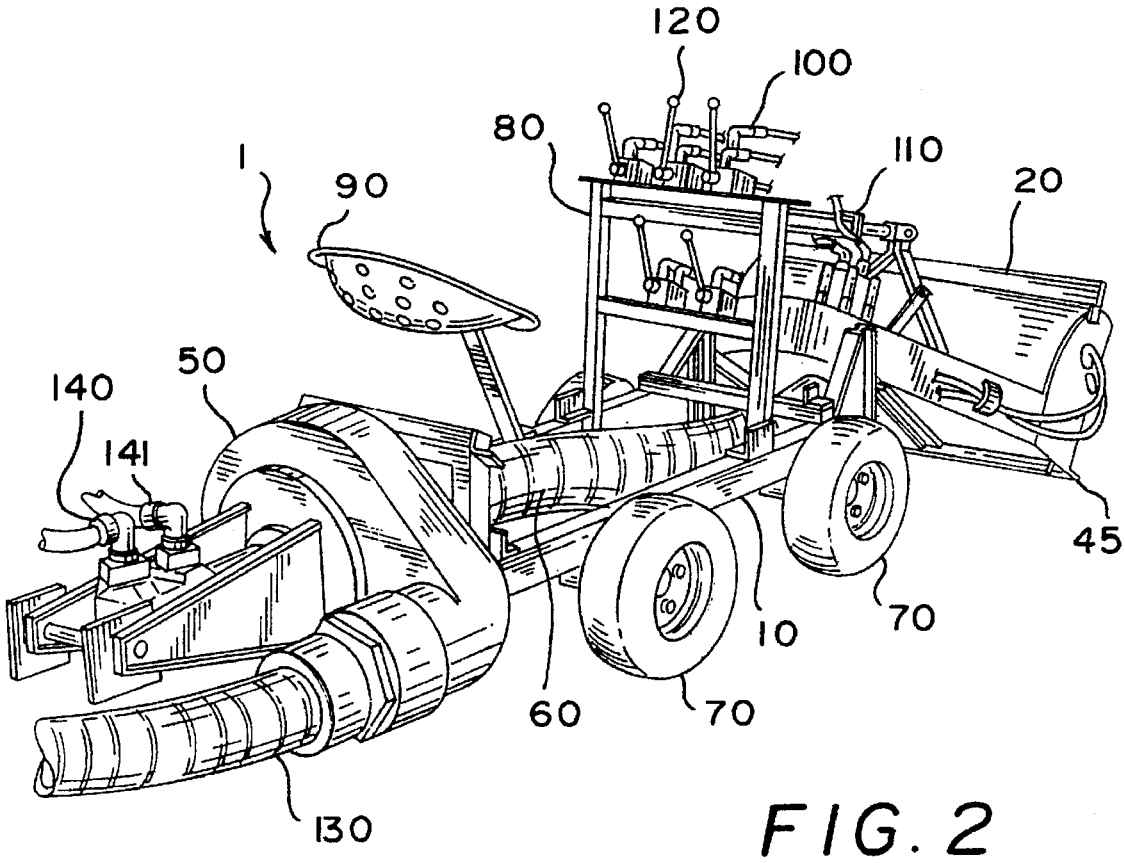
FIG. 2 is an illustrative diagram showing a rear perspective view of the tank-cleaning apparatus.

Referring to the drawings, and in particular to FIGS. 1–4, the tank-cleaning apparatus 1 is shown having a header 20 within which a cutter head 30 provided with a plurality of circumferentially arranged blades or tines 40 is releasably attached. The cutter head 30 is rotatably disposed within a front portion of the header 20. The header 20 is also provided with a scything blade 45 which is useful in scraping built-up solids from a floor of a tank to insure cutting of a maximum amount of material from the floor of the tank. The scything blade 45 is also helpful in providing an area having better traction for the apparatus 1. It is preferable to position the blade 45 as close as possible to the cutter head 30 so that material may be powered from the cutting edge by the cutter head 30, thereby reducing resistance and keeping the blade clean. The header 20 is releasably mounted on a frame 10 of the tank-cleaning apparatus 1 and can be moved up and down by a hydraulic ram 110. The frame 10 supports a plurality of wheels 70 which are releasably connected at predetermined locations about the frame 10. The frame 10 is also equipped with a seat 90 on which an operator can sit during operation of the tank-cleaning apparatus 1. A pump 50 is releasably connected toward a rear portion of the frame 10 and is connected to the header 20 by a flexible hose 60. The pump 50 may optionally be supplied with a second flexible hose 130 connected to an outlet of the pump 50.

A number of control arms 120 are positioned on a secondary frame 80. The secondary frame 80 and control arms 120 make up a control bank which is detachably connected to the frame 10 and used by an operator to control the various functions and operations of the tank-cleaning apparatus 1. The control arms 120 control hydraulic valves which, in turn, control various components of the tank-cleaning apparatus 1 through hydraulic pressure control hoses 100. The pump 50 is also hydraulically controlled and is actuated via pressure and return lines 140, 141.

Figure 3:
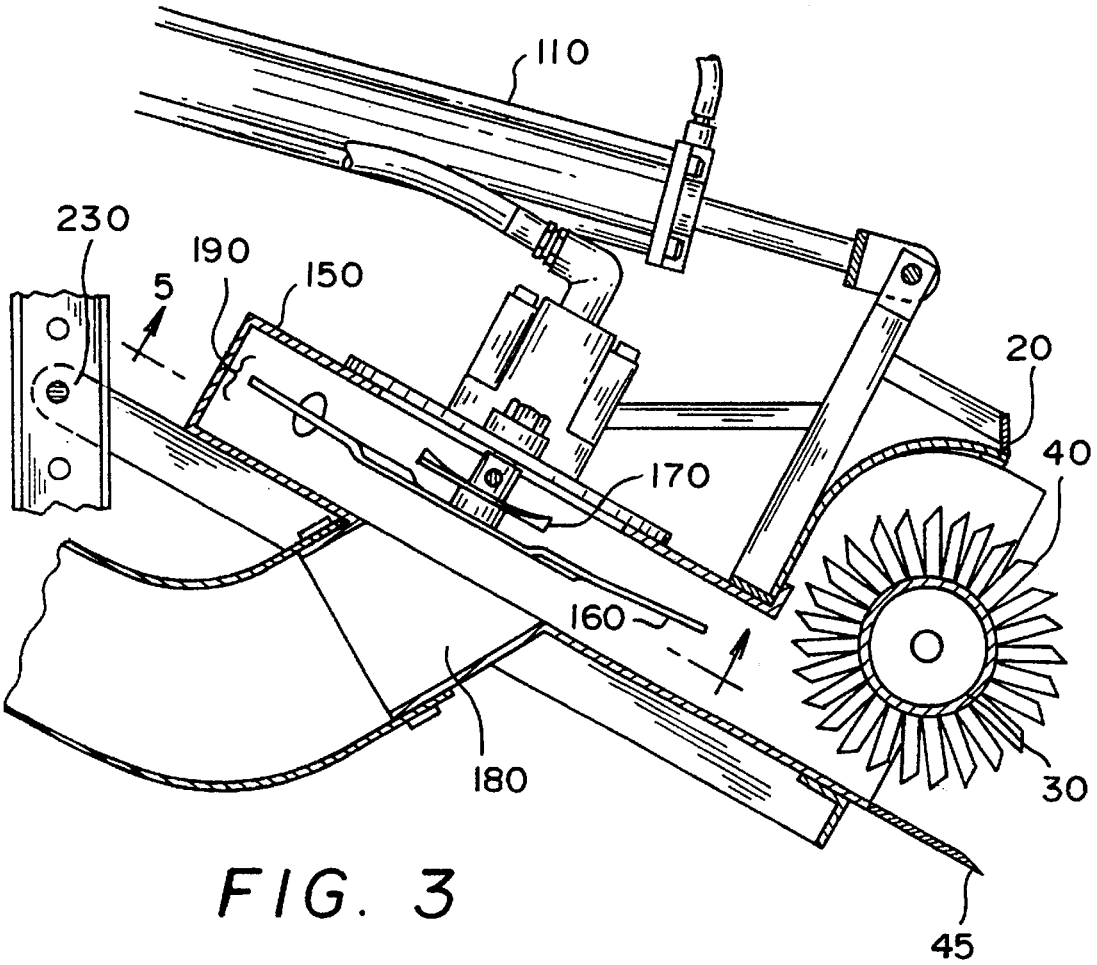
FIG. 3 is a diagram showing a cross section of the header assembly.

FIG. 3 shows a cross-sectional view of the header assembly 20. In addition to housing the cutter head 30, the header 20 also has a throat 150 within which a cross-chopper assembly 190 is disposed. The cross-chopper 190 is made up of two rotatably mounted blades 160, 170. The cross-chopper 190 further reduces material received from the cutter head and expels the material from the header 20 via an opening 180. The opening 180 is connected to one end of the flexible hose 60 which is connected at a second end to an intake of the pump 50. In addition, the vertical displacement of the header 20 is controlled by a hydraulic ram 110 which is controlled by a control arm 120 of the control panel of the secondary frame 80.

Figure 4:
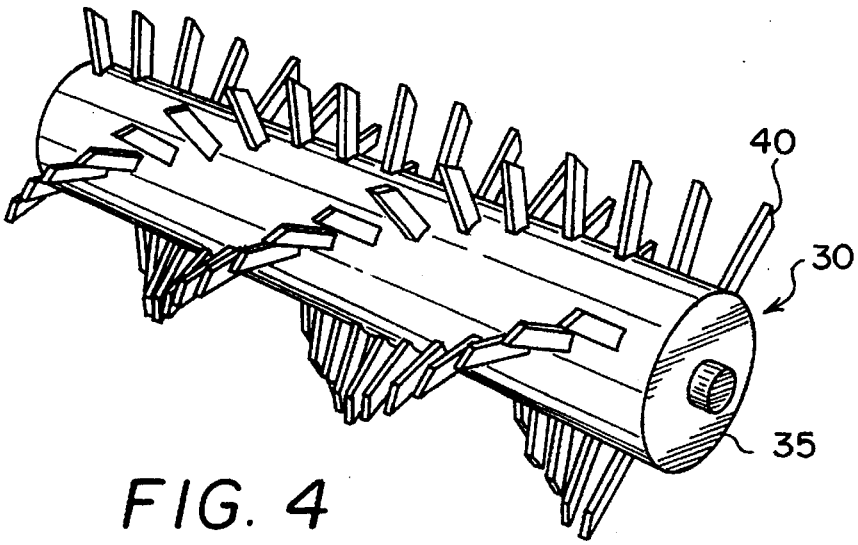
FIG. 4 is an illustrative diagram showing a perspective view of the cutter head.

As shown in FIG. 4, the blades 40 of the cutter head 30 are preferably arranged in a helical pattern about a cylindrical support member 36. Arranging the blades 40 in this manner facilitates breaking up the bottom-deposited solids and transport of the broken up bottom-deposited solids to the throat 190 of the header 20 for subsequent processing by the cross-chopper assembly 190. The cutter head 30 is actuated by a hydraulic motor 35 which causes the cutter head to rotate about its longitudinal axis.

The throat 150 of the header assembly 20 is shown in a sectional view along line I—I of FIG. 3 in FIG. 5. As is readily apparent, the blades 40 of the cutter head 30 are arranged to break up and feed the loosened bottom-deposited material into the throat 150. The throat 150 is supplied with cross chopping blades 160, 170 which further reduce the material supplied by the cutter head 30. The throat may optionally be provided with a pipe fitting 200 which can be connected to a hose, or the like, for providing additional liquid to the loosened bottom-deposited material as it is processed by the cross-chopper 190 thereby forming a slurry which can be reintroduced into the manufacturing environment.

The frame 10 is also provided with a header support assembly 220, shown in FIG. 6, to which the header assembly is releasably connected in a predetermined position. The vertical position of the header assembly is determined by holes provided in a pair of parallel structural members that comprise the header support assembly 220. A bolt or other releasable affixing means (not shown) is passed through a selected hole and a header support member 230 shown in FIG. 3. Determining the height of the header is important and depends upon the amount and distribution of the bottom-deposited materials.

The wheels 70 are also releasably bolted to the frame 10, preferably by a single bolt 75. It is preferred that the wheels 70 be easily attached to the frame by a single bolt or the like to facilitate easy knockdown and reassembly of the tank-cleaning apparatus.

A hub 77 is attached to each wheel 70 by four bolts to form a wheel and hub assembly. The shaft (not shown) upon which each wheel and hub assembly is mounted comprises a spline shaft, preferably having a male connection. The hub 77 comprises a female spline that slides onto the spline of the shaft. A single bolt 75 is used to secure the wheel and hub assembly to the shaft. Each of the wheels is driven by a hydraulic motor 215. Pairs of wheels on each side of the apparatus are in hydraulic communication via a hydraulic line 210. The wheels preferably provide skid-steer forward and reverse propulsion to the tank-cleaning apparatus 1. Skid-steer propulsion is well known in the art and is used in machines such as the Bobcat used in prior art methods. To further assist in the operation of the cleaning apparatus, the scything blade 45 scrapes excess material, leaving an area that provides improved traction for the wheels of the apparatus 1.

Figure 7:
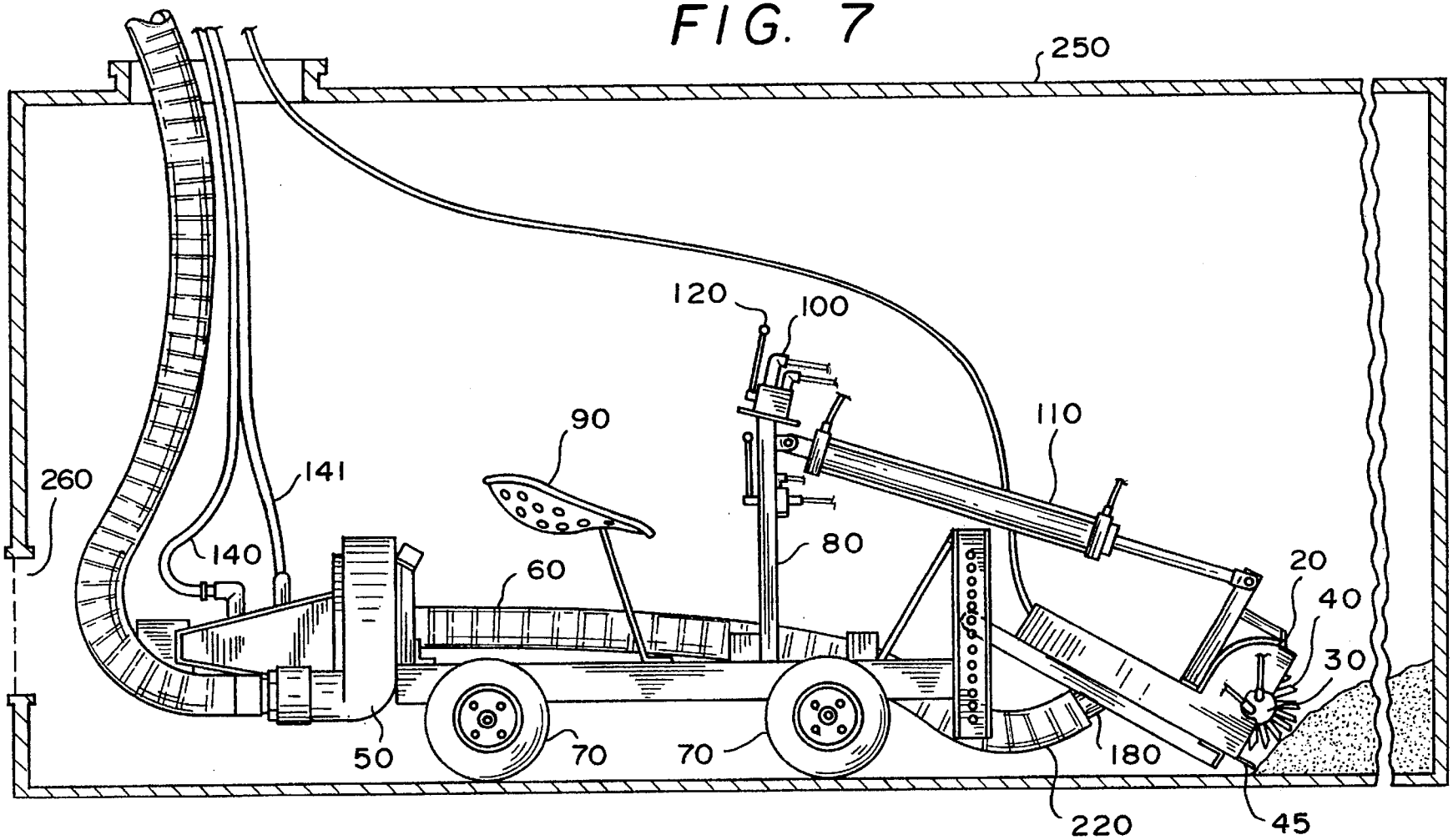
FIG. 7 is an illustrative diagram showing the tank- cleaning apparatus within a tank.

Turning to the operation of the tank-cleaning apparatus 1, reference is made to FIG. 7. The tank-cleaning apparatus 1, as described above, has a preferably knockdown arrangement. In other words, it is preferred that apparatus have a knockdown frame 10 and components mounted on the knockdown frame 10, such as, for example, the header 20, the cutter head 30, the wheels 70, the pump 50, etc., that are releasably connected to the frame to facilitate easy break down and assembly of the tank-cleaning apparatus. This knockdown construction allows the tank-cleaning apparatus 1 to be easily broken down and passed through a standard 24" man-way 260 provided in the side of, or optionally in the top of, the tank. Once the components of the apparatus are disassembled, they are passed through the man-way 260 and reassembled inside the tank. All components are provided with few connecting assemblies to facilitate the easy knocking down and subsequent reassembly of the apparatus.

Referring to FIG. 7, the tank-cleaning apparatus 1 is shown, after reassembly, inside the tank 250. The tank 250 is taken off-line from the plant which supplies it. This means that the tank can no longer receive materials from the plant, and removal of the bottom-deposited solids can proceed without interference from the factory. Once the tank is taken off-line, excess liquid residing above the bottom-deposited solids is removed until a small portion, such as, for example, 12" to 15" of fluid, remains above the bottom-deposited solids. A man-way is opened and the tank-cleaning apparatus broken down to fit through the man-way. It is often the case that the bottom-deposited solids are deep enough to cover the entrance at the man-way access point. In that case, a portion of the bottom-deposited solids must be removed prior to passing the broken down assembly through the man-way. Once an area has been cleared, the disassembled components of the tank-cleaning apparatus are passed through the man-way. An operator then accesses the interior of the tank through the man-way and enters the tank.

The operator then reassembles the broken down components of the tank-cleaning apparatus inside the tank and connects the hydraulic lines to the appropriate locations on the apparatus. To avoid interference from the additional hydraulic lines and other optional lines that may be present, the frame of the apparatus may be optionally provided with stanchions that keep the lines out of the operator's way and provide a clear and unobstructed work environment.

Once the tank-cleaning apparatus 1 is assembled within the tank 250, the operator begins to break down the bottom-deposited solids using the rotating cutter head 30. As the bottom-deposited solids are broken up, the cutter head 30 causes the broken up solids to be transported to the cross-chopper 190 located in the throat 150 of the header assembly 20. This movement of broken-down solids is facilitated by the helical arrangement of the blades 40 on the cutter head 30. The cross-chopper assembly 190 further breaks down the solids received from the cutter head 30 to form more finely ground solids. The finely ground solids are formed into a slurry using either the excess liquid left in the tank prior to cleaning or by using fluid provided by a hose which can be optionally connected to the throat 150 by optional pipe fitting 200.

The slurry, thus formed, is now in the proper form for reclamation by the facility that produced the bottom-deposited solids. The slurry may be pumped out of the tank directly by the cleaning apparatus 1 or may be pumped to a predetermined location within the tank for subsequent pumping by a second pump that is independent of the cleaning apparatus. An exemplary pump for use in the apparatus is a 6" or 4" submersible pump manufactured by Innovative Material Systems, Inc. (IMS), of Olath Kansas. If the cleaning apparatus is used, the slurry is fed to the pump 50 through a flexible hose 60 which is connected at one end to the opening 180 and at the other to the intake of the pump. The pump 50 then pumps the slurry to a location outside the tank for reclamation. If an auxiliary pump is used, the pump 50 causes the slurry to be deposited at a predetermined location within the tank where the auxiliary pump is located. The auxiliary pump then transports the slurry to a location for reclamation.

The bottom-deposited solids often reach depths of over 6 feet. In order to break down the solids, the tank-cleaning apparatus is provided with a hydraulic ram 110 that raises and lowers the header assembly on command of the operator via the control valves and arms 120. This arrangement allows the operator to work horizontally and vertically to achieve efficient removal of the bottom-deposited solids.

Figure 8:
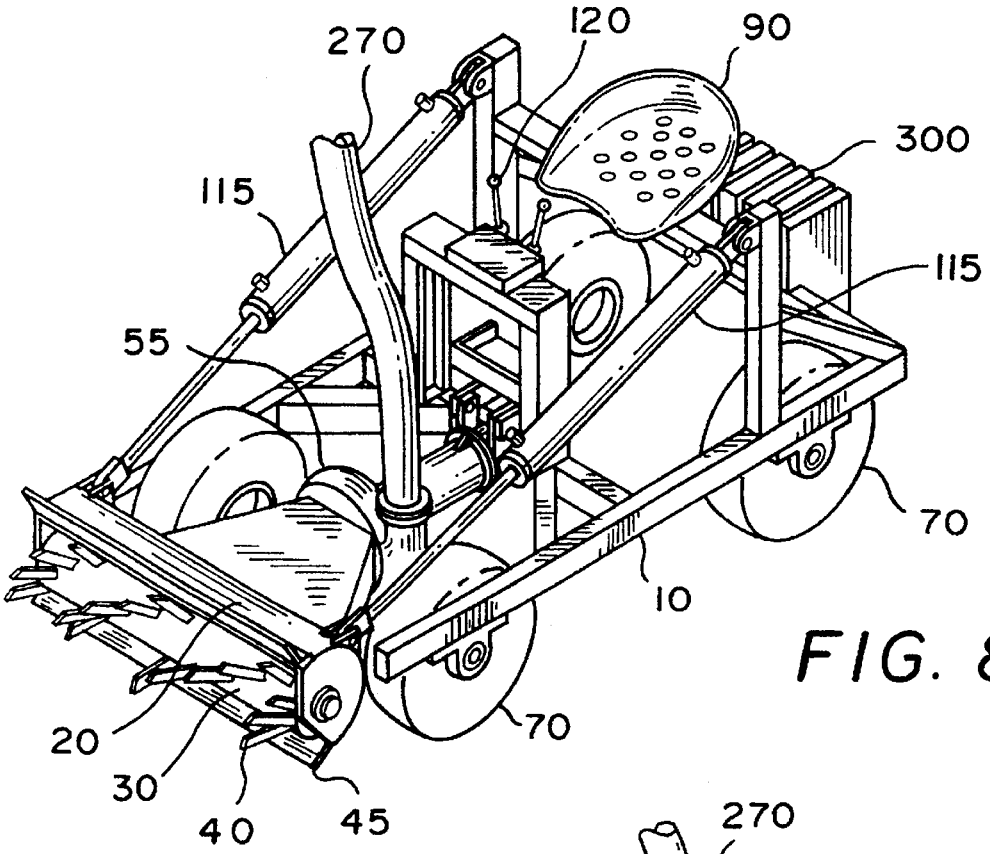
FIG. 8 is an illustrative diagram showing a front perspective view of an alternative embodiment of the tank-cleaning apparatus.
Figure 9:
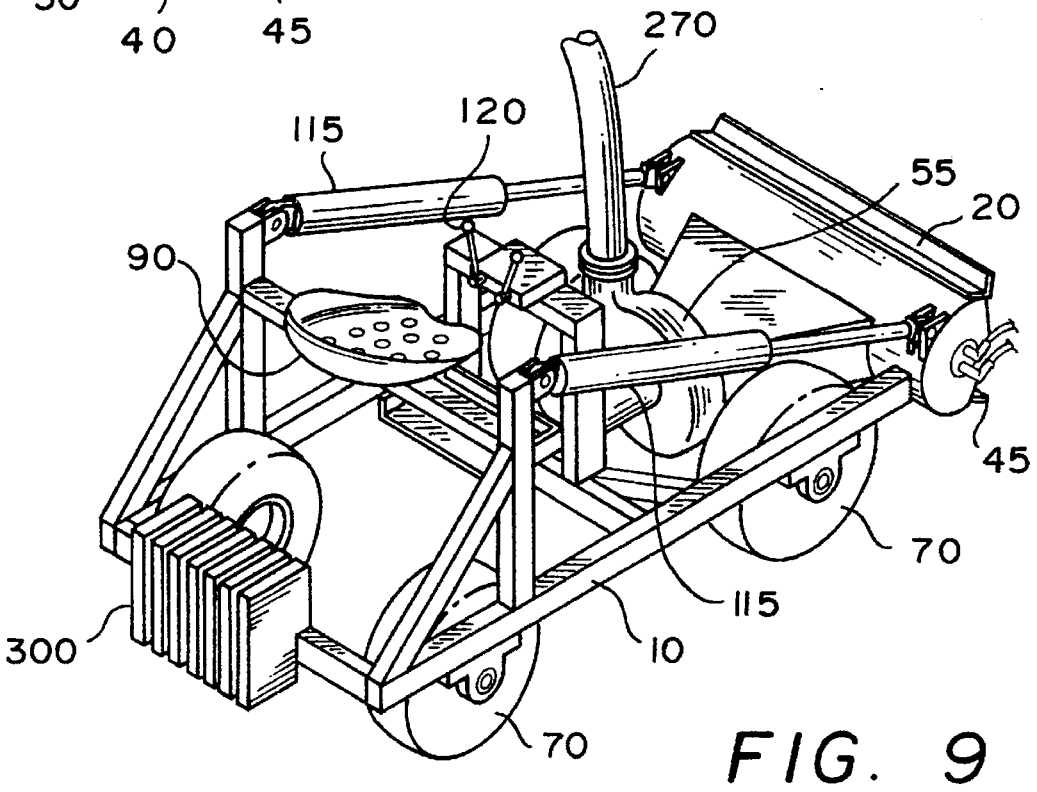
FIG. 9 is an illustrative diagram showing a rear perspective view of an alternative embodiment of the tank-cleaning apparatus.
Figure 10:
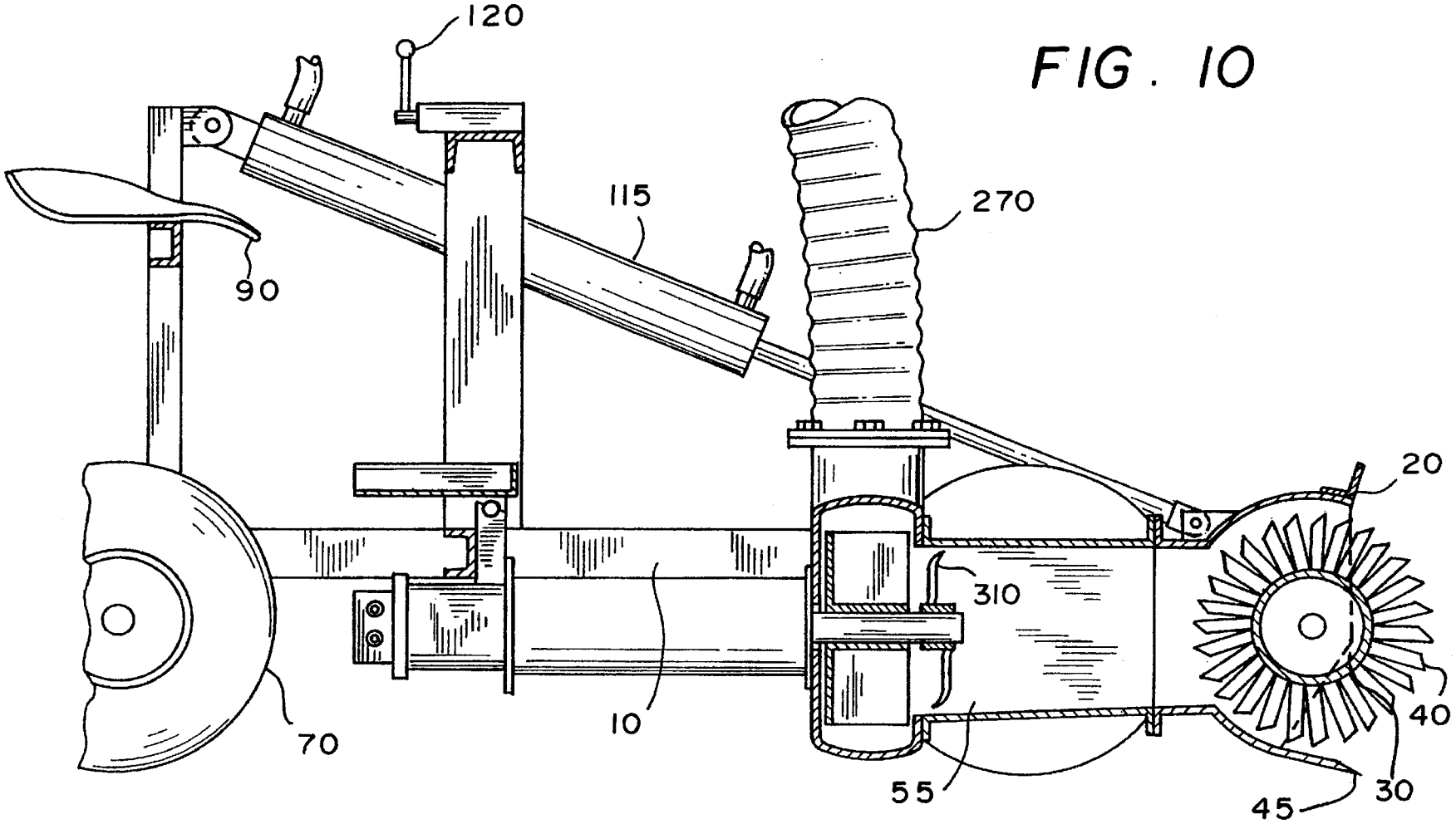
FIG. 10 is a diagram showing a cross-section of a front portion of an alternative embodiment of the tank-cleaning apparatus.

In an alternative embodiment of the tank-cleaning apparatus, shown in FIGS. 8–10, the need for a separate cross-chopper assembly 190 and transport tube 60 for transporting broken-down material from the cross-chopper to the pump 50 is obviated. In this embodiment, as shown in FIGS. 8–10, the frame 10 is reduced in length, and counterbalancing weights 300, such as, for example, concrete slabs, are added for stability, because much of the weight of the apparatus is moved forward. The header assembly 20 is the same as that shown in FIG. 1 and described above. Due to the compact construction of this embodiment, the hydraulic ram 110 used in the earlier embodiment is replaced by two parallel hydraulic rams 115 controlled by lever 120. A pump 55 is directly connected to the header for receiving broken-down solids from the rotating cutter head 30. The pump 55 includes an internal impeller 310, which performs the function of the cross-chopper 190 described above. This embodiment reduces the hydraulic requirements of the system and provides a more compact apparatus. In addition, the wheels 70 can be moved inside the frame 10 which allows greater mobility and traction.

The operation of the apparatus shown in FIGS. 8–10 is similar to that described above with respect to FIGS. 1–7. The primary difference in operation is that when the broken-down materials are fed into the header assembly 20, they pass directly to the pump 55 having impellers 310 that perform the cross-chopping function. This pump could be, for example, a three- or four-inch cutter pump from Vaughan Co., Inc., of Montesanto, Wash. The broken-down solids, in slurry form, are then directly transferred via hose 270 either outside the tank or to another location for subsequent pumping. Thus, the need for a throat assembly 180 as shown above is obviated.

Figure 11:
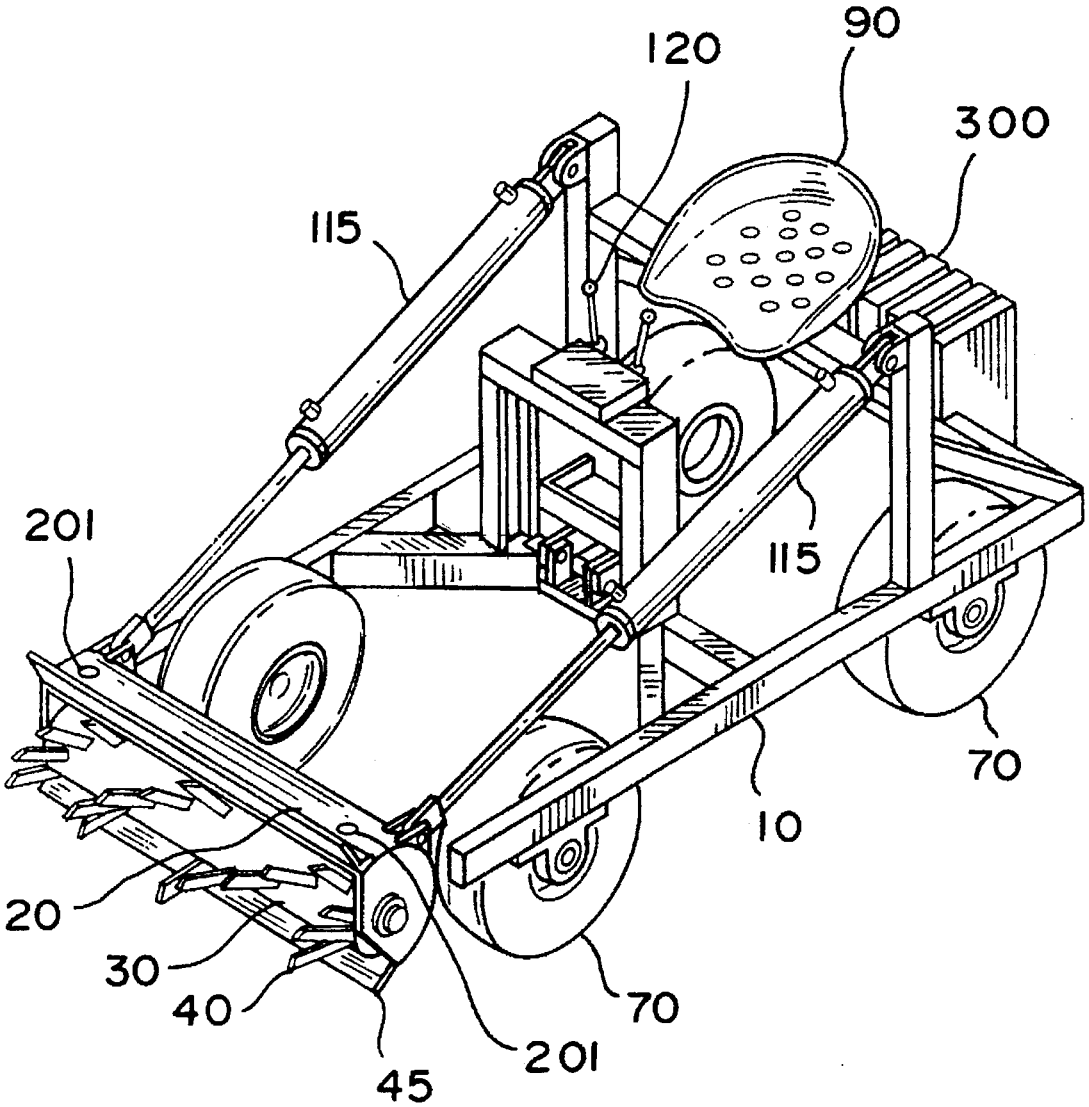
FIG. 11 is an illustrative diagram showing a front perspective view of another embodiment of the tank-cleaning apparatus.
Figure 12:
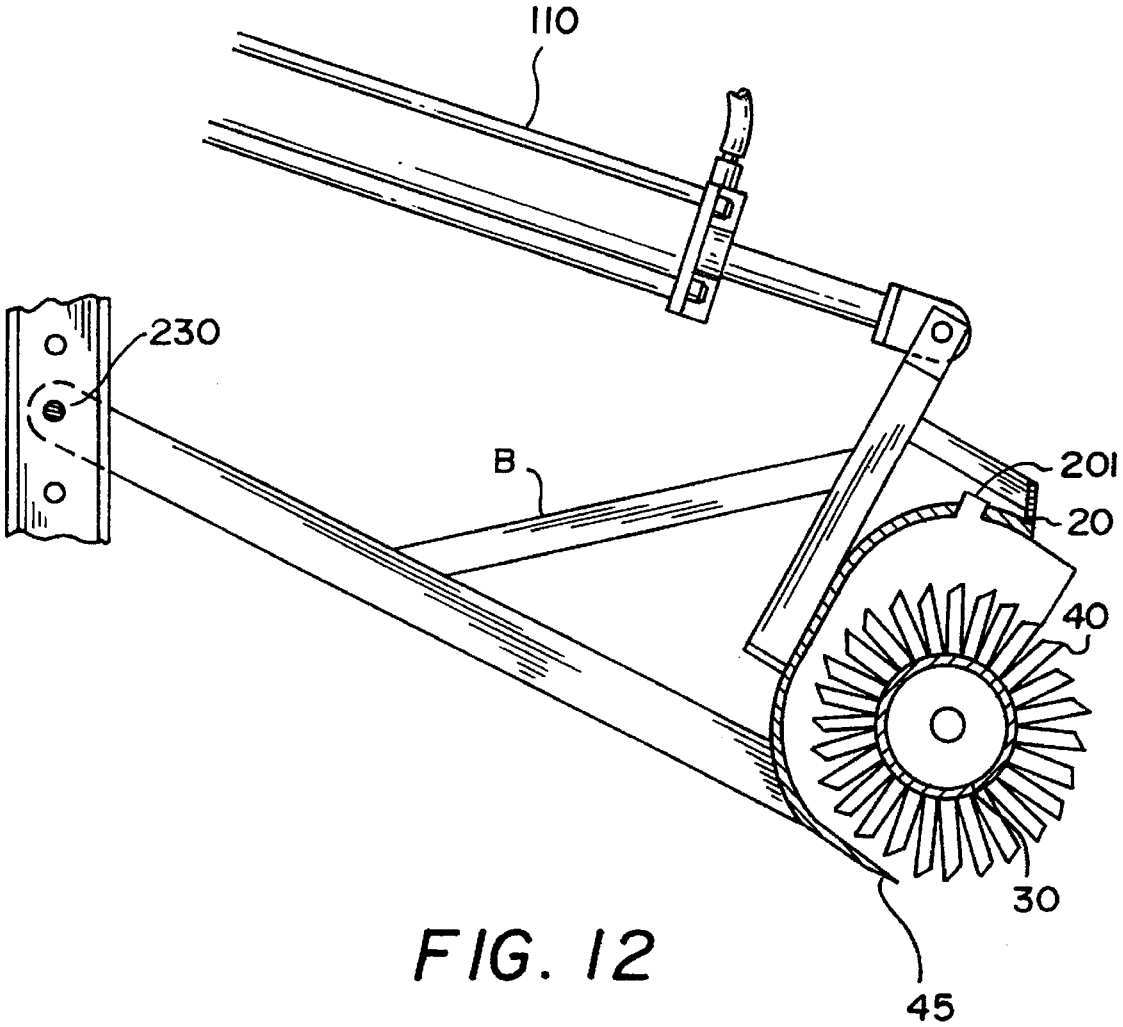
FIG. 12 is a diagram showing a cross-section of a front portion of another embodiment of the tank-cleaning apparatus.

Another embodiment of the tank-cleaning apparatus is shown in FIGS. 11 and 12. The tank-cleaning apparatus shown in FIG. 11 is very similar to that shown in FIGS. 8–10. However, in this embodiment, there is no pump attached to the header 20. When using the tank-cleaning apparatus shown in FIG. 11, an amount of residual fluid is left in the tank prior to loosening the deposited material. The cutter head 30, in conjunction with the scything blade 45 are actuated, and act to loosen the solids. As the cutter head 30 loosens the solids, the loosened solids become mixed with the residual fluids to form a slurry. This slurry is subsequently transported outside the tank by a separate pump (not shown). The cutter head 30 may be optionally provided with one or more pipe fittings 201 which are adapted to receive a hose. The hose would optionally provide additional fluid to facilitate the formation of a slurry.

A cross-sectional view of the header assembly 20 of this embodiment is shown in FIG. 12. In addition to removing the pump shown in FIGS. 8–10, the assembly shown in FIG. 12 includes a brace B which provides additional support to the header assembly 20. This embodiment further realizes the advantages of compact construction and reduced hydraulic requirements of the embodiment shown in FIGS. 8–10, while further reducing the size of the apparatus and hydraulic requirements by eliminating the pump.

While the invention has been described in conjunction with specific embodiments thereof, it is evident that many alternatives, modifications and variations will be apparent to those skilled in the art. Accordingly, the preferred embodiments of the invention as set forth herein, are intended to be illustrative, not limiting. Various changes may be made without departing from the spirit and scope of the invention, as described herein and in the following claims.

What is claimed is:

1. A tank-cleaning apparatus, comprising:

a frame;

a header mounted on a first portion of said frame, said header comprising a shroud;

a cutter head rotatably disposed in an interior portion of said header and being substantially enclosed within said shroud;

a throat portion disposed toward a rear portion of said header, said throat portion receiving material from the cutter head when said cutter head is rotatably actuated by a drive mechanism;

a cross-chopper disposed within said throat portion of said header, said cross-chopper further reducing the material received by the throat portion from the cutter head; and an opening located at the rear portion of the header for receiving the reduced material therethrough.

2. The tank-cleaning apparatus of claim 1, further comprising a plurality of wheels disposed at predetermined locations about a periphery of the frame.

3. The tank-cleaning apparatus of claim 1, further comprising a hydraulic ram attached at a first end to the frame and at a second end to the header, said hydraulic ram raising and lowering the header.

4. The tank-cleaning apparatus of claim 3, further comprising a seat attached to said frame.

5. The tank-cleaning apparatus of claim 3, wherein said drive mechanism comprises a hydraulic driving mechanism for providing propulsion to said cleaning apparatus, said hydraulic driving mechanism coupled to the frame and providing power to said wheels, said hydraulic arm, said cutter head and said cross-chopper.

6. The tank-cleaning apparatus of claim 5, wherein the frame further comprises a secondary frame releasably attached thereto, wherein a control bank providing a plurality of control arms for controlling functions provided by the hydraulic driving mechanism and for controlling said hydraulic ram is mounted on the secondary frame.

7. The tank-cleaning apparatus of claim 1, further comprising a pump mounted on a second portion of the frame, said pump pumping the reduced material from the header through the opening and a tubular member connecting the opening to an intake portion of the pump.

8. The tank-cleaning apparatus of claim 7, wherein an outlet of said pump is connected to a flexible member which transports pumped material outside the tank.

9. The tank-cleaning apparatus of claim 1, wherein said header is adapted to receive a hose through which fluid is added to the material loosened by the cutter head when it is rotatably actuated by the driving mechanism, said fluid forming a slurry of loosened material.

10. The tank-cleaning apparatus of claim 1, wherein the header further comprises a blade disposed on a bottom portion of said header.

11. The tank-cleaning apparatus of claim 1, wherein:

said header is releasably coupled to the front portion of the frame;

said plurality of wheels are releasably coupled to the frame;

said cutter head is releasably coupled to the header; and said frame is a knockdown frame comprising a plurality of frame members, each of said plurality of frame members being releasably connected to an adjacent frame member.

12. A knockdown tank-cleaning apparatus, comprising:

a knockdown frame defining a periphery and having a front portion and a rear portion;

a plurality of wheels releasably mounted in predetermined locations about the periphery of said frame;

a header, releasably coupled to the front portion of said frame, said header comprising: a shroud; a cutter head detachably and rotatably disposed within said header and being substantially enclosed within said shroud; a throat for receiving material from the cutter head when said cutter head is rotatably actuated by a hydraulic driving mechanism; a cross-chopper disposed within the throat of the header, said cross-chopper further reducing the material received from the cutter head; and an opening located at a rear portion of the header, said opening allowing transfer of the reduced material from the header.

13. The tank-cleaning apparatus of claim 12, wherein each of said plurality of wheels is mounted on said frame by one bolt.

14. The tank-cleaning apparatus of claim 12, wherein said header further comprises a pipe fitting located at a rear portion of the header for connection to a hose, said hose providing liquid directly to the material supplied by the cutter head to form a slurry.

15. The tank-cleaning apparatus of claim 12, further comprising a hydraulic ram disposed between said header and said frame, said hydraulic ram being actuated by said hydraulic driving mechanism, said hydraulic ram raising and lowering said header.

16. The tank-cleaning apparatus of claim 15, wherein said frame further comprises a secondary frame detachably coupled to the knockdown frame and disposed toward the front portion of the frame, said secondary frame housing a plurality of control arms, said control arms controlling control valves that control movement of all hydraulically actuated components of said tank-cleaning apparatus.

17. The tank-cleaning apparatus of claim 15, further comprising at least one stanchion releasably connected to the frame, said stanchion being adapted to hold hydraulic and fluid lines and hoses at a predetermined distance from the frame.

18. A knockdown tank-cleaning apparatus comprising:

a frame;

a mechanism for providing propulsion to said frame;

a header releasably coupled to a portion of said frame and protruding from said frame; and a cutter head rotatably and releasably carried by said header, said cutter head having a plurality of material-engaging elements disposed thereon;

wherein said cutter head is positioned on said header such that said material-engaging elements protrude forwardly past said header and, when rotated, will engage and loosen solid material disposed in a tank, said header and said cutter head further being so constructed and arranged to engage and loosen solid material down to substantially a floor level of a tank in which said apparatus is operated; and wherein said apparatus is readily assemblable and disassemblable such that said apparatus can be passed through a standard man-way opening into and out of a closed tank.

19. The tank-cleaning apparatus of claim 18, further comprising a pump releasably mounted to a rear portion of said header.

20. The tank-cleaning apparatus of claim 19, wherein said pump comprises at least one impeller for reducing material received from the header.

21. The tank-cleaning apparatus of claim 20, wherein an outlet of said pump is connected to a flexible transport member which transports pumped material.

22. The tank-cleaning apparatus of claim 19, further comprising a plurality of wheels disposed at predetermined locations about said frame.

23. The tank-cleaning apparatus of claim 18, further comprising a plurality of wheels disposed at predetermined locations about said frame.

24. The tank-cleaning apparatus of claim 18, further comprising a hydraulic ram attached at a first end to the frame and at a second end to the header, said hydraulic ram raising and lowering the header.

25. The tank-cleaning apparatus of claim 24, further comprising a plurality of wheels disposed at predetermined locations about said frame and a hydraulic-drive mechanism for providing propulsion to said cleaning apparatus, said hydraulic-drive mechanism providing power to said plurality of wheels, said hydraulic arm, a pump and said cutter head.

26. The tank-cleaning apparatus of claim 25, wherein the frame further comprises a secondary frame releasably attached thereto, wherein a control bank providing a plurality of control arms for controlling functions provided by said hydraulic-drive mechanism and for controlling said hydraulic ram are mounted in said secondary frame.

27. The tank-cleaning apparatus of claim 26, further comprising a plurality of counterbalancing weights disposed toward a rear portion of the tank-cleaning apparatus for providing stability to the tank-cleaning apparatus.

28. The tank-cleaning apparatus of claim 18, further comprising a seat attached to said frame.

29. The tank-cleaning apparatus of claim 18, wherein said header contains at least one fitting to receive and connect to a hose whereby, when said hose is connected, fluid may be added to material loosened by the cutter head when it is rotatably activated by a driving mechanism.

30. The tank cleaning apparatus of claim 18, wherein said header comprises a shroud, and wherein said cutter head is partially enclosed within said shroud.

31. The tank cleaning apparatus of claim 18, wherein said apparatus is readily disassemblable such that said apparatus can be passed through man-way openings ranging in size from about 20 inches to about 36 inches in diameter.

* * * * *